US011808163B2

(12) United States Patent
Sugiura et al.

(10) Patent No.: US 11,808,163 B2
(45) Date of Patent: Nov. 7, 2023

(54) TURBINE HOUSING AND TURBOCHARGER

(71) Applicant: IHI Corporation, Tokyo (JP)

(72) Inventors: Hikaru Sugiura, Tokyo (JP); Yuji Sasaki, Tokyo (JP); Kai Iijima, Tokyo (JP); Ryosuke Yumoto, Tokyo (JP); Tatsuya Fukui, Tokyo (JP); Yoshihito Katsu, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 17/450,853

(22) Filed: Oct. 14, 2021

(65) Prior Publication Data

US 2022/0034239 A1 Feb. 3, 2022

Related U.S. Application Data

(63) Continuation of application No. PCT/JP2020/013439, filed on Mar. 25, 2020.

(30) Foreign Application Priority Data

Apr. 17, 2019 (JP) ..... 2019-078484

(51) Int. Cl.

| | |
|---|---|
| ***F01D 25/26*** | (2006.01) |
| ***F01D 9/02*** | (2006.01) |
| *F02B 33/32* | (2006.01) |

(52) U.S. Cl.

CPC ..... *F01D 25/26* (2013.01); *F01D 9/026* (2013.01); *F02B 33/32* (2013.01); *F05D 2220/40* (2013.01); *F05D 2260/231* (2013.01)

(58) Field of Classification Search

CPC ..... F01D 25/14; F01D 25/26; F01D 9/026; F02B 33/32; F02B 39/00; F05D 2220/40; F05D 2230/21; F05D 2260/231

See application file for complete search history.

(56) References Cited

U.S. PATENT DOCUMENTS 4,147,467 A * 4/1979 Leicht ..... F01D 25/14 415/196
8,628,296 B2 * 1/2014 Grussmann ..... F01D 25/243 415/204

(Continued)

FOREIGN PATENT DOCUMENTS

DE 10 2009 007 734 A1 8/2010
JP 57-030332 U1 2/1982

(Continued)

OTHER PUBLICATIONS

International Search Report dated Jun. 23, 2020 in PCT/JP2020/013439 filed on Mar. 25, 2020, 4 pages (with English Translation).

*Primary Examiner* — Jesse S Bogue
(74) *Attorney, Agent, or Firm* — Oblon, McClelland, Maier & Neustadt, L.L.P.

(57) ABSTRACT

A turbine housing has: a first inner member; a second inner member contacting with the first inner member; a turbine scroll flow path enclosed and defined by the first inner member and the second inner member; a first casting housing covering the first inner member at a side opposite to the second inner member; a second casting housing covering the second inner member at a side opposite to the first inner member; an aperture formed in one or both of the first casting housing and the second casting housing and including an opening that opens to an outside; a tube member arranged in the aperture and defining an inlet flow path connected to the turbine scroll flow path; and an inner opening defined by the first inner member and the second inner member and overlapping with one end of the tube member.

8 Claims, 7 Drawing Sheets

(56) References Cited

U.S. PATENT DOCUMENTS

| | | | | |
|---|---|---|---|---|
| 8,726,655 | B2 * | 5/2014 | Smatloch | F02B 39/00 60/602 |
| 9,255,485 | B2 * | 2/2016 | Watanabe | F01D 9/026 |
| 9,567,870 | B2 * | 2/2017 | Bogner | F02C 6/12 |
| 9,828,873 | B2 * | 11/2017 | Maeda | F04D 25/04 |
| 10,690,144 | B2 * | 6/2020 | Nandagopal | F04D 29/624 |
| 11,098,614 | B2 * | 8/2021 | Hiller | F01D 25/145 |
| 11,428,108 | B2 * | 8/2022 | Kitamura | F01D 11/003 |
| 2004/0109759 | A1 * | 6/2004 | Korner | F02B 39/00 60/602 |
| 2011/0252775 | A1 * | 10/2011 | Joergl | F01N 13/146 60/321 |
| 2012/0201655 | A1 | 8/2012 | Kusakabe et al. | |
| 2013/0323021 | A1 * | 12/2013 | Bogner | F04D 29/584 415/116 |
| 2015/0337858 | A1 | 11/2015 | Joergl et al. | |
| 2018/0291764 | A1 * | 10/2018 | Hossbach | F02C 6/12 |
| 2019/0120132 | A1 | 4/2019 | Bogner | |
| 2019/0234422 | A1 | 8/2019 | Kitamura et al. | |

FOREIGN PATENT DOCUMENTS

| | | | |
|---|---|---|---|
| JP | 63-111234 | A | 5/1988 |
| JP | 07-139364 | A | 5/1995 |
| JP | 2002-349275 | A | 12/2002 |
| JP | 2016-031027 | A | 3/2016 |
| JP | 2016-075287 | A | 5/2016 |
| JP | 2016-153607 | A | 8/2016 |
| JP | 6300675 | B2 | 3/2018 |
| JP | 2018-179001 | A | 11/2018 |
| WO | WO 2017/174287 | A1 | 10/2017 |
| WO | WO 2018/109933 | A1 | 6/2018 |

* cited by examiner

TURBINE HOUSING AND TURBOCHARGER

CROSS REFERENCE TO RELATED APPLICATIONS

This application is a continuation application of International Application No. PCT/JP2020/013439, filed on Mar. 25, 2020, which claims priority to Japanese Patent Application No. 2019-078484, filed on Apr. 17, 2019, the entire contents of which are incorporated by reference herein.

BACKGROUND ART

Technical Field

The present disclosure relates to a turbine housing and turbocharger.

A turbine scroll flow path is formed inside a turbine housing of a turbocharger. For example, Patent Literature 1 describes a double structure in which a member (inner cylinder) forming a turbine scroll flow path is covered by another member (outer cylinder). The outer and inner cylinders are made of sheet metal.

CITATION LIST

Patent Literature

Patent Literature 1: JP H7-139364 A

SUMMARY

Technical Problem

When a turbine housing has a double structure, casting may be used for a member covering an outside of a member defining a turbine scroll flow path. In this case, the outer member is difficult to cast, since it has a complicated shape corresponding to the shape of the turbine scroll flow path.

An object of the present disclosure is to provide a turbine housing and a turbocharger that can be easily cast.

Solution to Problem

In order to solve the above problem, a turbine housing according to one aspect of the present disclosure has a first inner member, a second inner member in contact with the first inner member, a turbine scroll flow path formed by being enclosed by the first inner member and the second inner member, a first casting housing covering the opposite side of the first inner member from the second inner member The first casting housing covers the first inner member opposite the second inner member, and the second casting housing covers the second inner member opposite the first inner member.

A first cooling flow path, formed in the first casting housing, through which the cooling medium is distributed, and a second cooling flow path, formed in the second casting housing, through which the cooling medium is distributed, may be provided.

The first cooling flow path and the second cooling flow path may be connected.

The first opening is formed in the first casting housing and is connected to the first cooling flow path, and the second opening is formed in the second casting housing and is connected to the second cooling flow path.

The first cooling flow path and the second cooling flow path may be non-connecting.

The first and second casting housings may be made of aluminum alloy.

The first inner member and the second inner member may be made of sheet metal.

An aperture formed in one or both of the first and second casting housings and having an opening that opens to the outside, and a tube member that is arranged inside the aperture and forms an inlet or outlet flow path that is connected to the turbine scroll flow path may be provided.

The aperture may be equipped with a press-fit member that is located on the opening side of the aperture rather than the tube member and is press-fitted into the aperture.

The tube member forms an inlet flow path and may have a connecting portion located between the turbine scroll flow path and the tube member, connected to the turbine scroll flow path and the inlet flow path, and diametrically opposed to one end of the tube member.

In order to solve the above problem, a turbocharger according to one aspect of the present disclosure is equipped with the above turbine housing.

Effects of Disclosure

According to the present disclosure, casting can be made easier.

DESCRIPTION OF EMBODIMENTS

Embodiments according to the present disclosure are described in detail below with reference to the accompanying drawings. Specific dimensions, materials, and numerical values, etc. shown in the embodiment are merely examples for a better understanding and do not limit the present disclosure, unless noted otherwise. In this document and the figures, elements having substantially the same functions and configurations are indicated with the same reference to omit redundant explanations. In addition, elements not directly related to the present disclosure are omitted from the figures.

Figure 1:
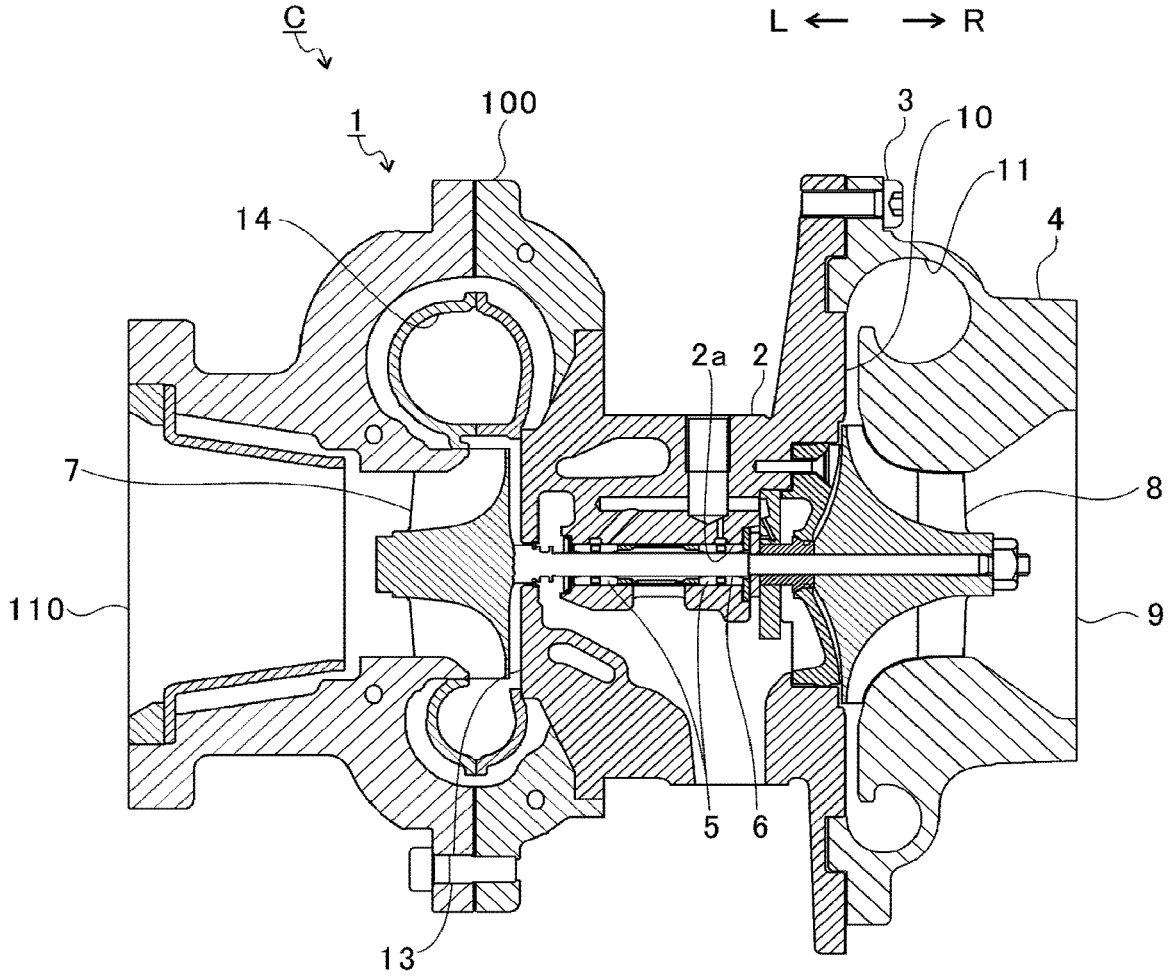
FIG. 1 is a schematic cross-sectional view of a turbocharger.

FIG. 1 is a schematic cross-sectional view of a turbocharger C. A direction of an arrow L shown in FIG. 1 is explained as a left side of the turbocharger C. A direction of an arrow R shown in FIG. 1 is explained as a right side of the turbocharger C. As shown in FIG. 1, the turbocharger C comprises a turbocharger body 1. The turbocharger body 1 includes a bearing housing 2. A turbine housing 100 is connected to a left side of the bearing housing 2 by an undescribed fastening member. A compressor housing 4 is connected to a right side of the bearing housing 2 by fastening bolts 3.

A housing hole 2*a* is formed in the bearing housing 2. The housing hole 2*a* passes through the bearing housing 2 in the left-right direction of the turbocharger C. A bearing 5 is provided in the housing hole 2*a*. In FIG. 1, a full-floating bearing is described as an example of the bearing 5. However, the bearing 5 may be any other radial bearing, such as a semi-floating bearing or a rolling bearing. A shaft 6 is rotatably supported by the bearing 5. A turbine impeller 7 is provided at a left end of the shaft 6. The turbine impeller 7 is rotatably housed in the turbine housing 100. A compressor impeller 8 is provided at a right end of the shaft 6. The compressor impeller 8 is rotatably housed in the compressor housing 4.

An inlet 9 is formed in the compressor housing 4. The inlet 9 opens on the right side of the turbocharger C. The inlet 9 is connected to an air cleaner (not shown). When the bearing housing 2 and compressor housing 4 are connected by the fastening bolts 3, a diffuser flow path 10 is formed. The diffuser flow path 10 pressurizes air. The diffuser flow path 10 is formed in an annular shape from the inside to the outside in the radial direction (hereinafter simply referred to as the radial direction) of the shaft 6 (compressor impeller 8). The diffuser flow path 10 is connected to the inlet 9 via the compressor impeller 8 in the inner part of the radial direction.

A compressor scroll flow path 11 is formed inside the compressor housing 4. The compressor scroll flow path 11 has an annular shape. The compressor scroll flow path 11 is located outside the compressor impeller 8 in the radial direction. The compressor scroll flow path 11 is connected to the cylinder of the engine (not shown). The compressor scroll flow path 11 is also connected to the diffuser flow path 10. When the compressor impeller 8 rotates, air is sucked into the compressor housing 4 from the inlet 9. The intake air is accelerated by centrifugal force when passing between the blades of the compressor impeller 8. The accelerated air is pressurized in the diffuser flow path 10 and compressor scroll flow path 11. The pressurized air flows out of the undescribed discharge port and is led to the engine cylinder.

The turbine housing 100 has an outlet 110. The outlet 110 opens on the left side of the turbocharger C. The outlet 110 is connected to the exhaust gas purification system (not shown). The turbine housing 100 also has a flow path 13 and a turbine scroll flow path 14. The turbine scroll flow path 14 is located outside the turbine impeller 7 in the radial direction. The flow path 13 is located between the turbine impeller 7 and the turbine scroll flow path 14.

Figure 2:
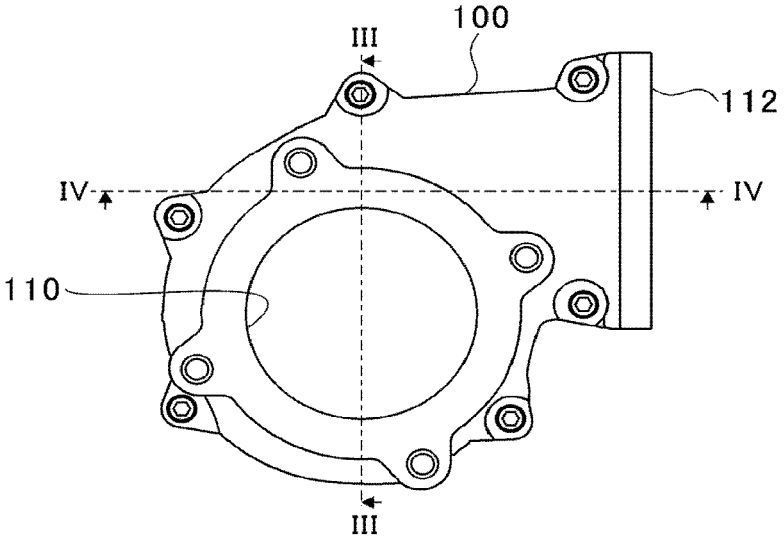
FIG. 2 is a view of a turbine housing seen from an outlet side.

FIG. 2 is a view of the turbine housing 100 seen from the outlet side. As shown in FIG. 2, an inlet 112 is formed in the turbine housing 100. The turbine scroll flow path 14 is connected to the inlet 112. Exhaust gas discharged from the exhaust manifold of the engine (not shown) is led to the inlet 112.

The turbine scroll flow path 14 is also connected to the flow path 13. The exhaust gas led from the inlet 112 into the turbine scroll flow path 14 is directed to the outlet 110 through the flow path 13 and between the blades of the turbine impeller 7. The exhaust gas led to the outlet 110 rotates the turbine impeller 7 when passing therethrough.

The rotational force of the turbine impeller 7 is transmitted to the compressor impeller 8 via the shaft 6. As described above, the air is pressurized by the rotational force of the compressor impeller 8 and led to the engine cylinder.

Figure 3:
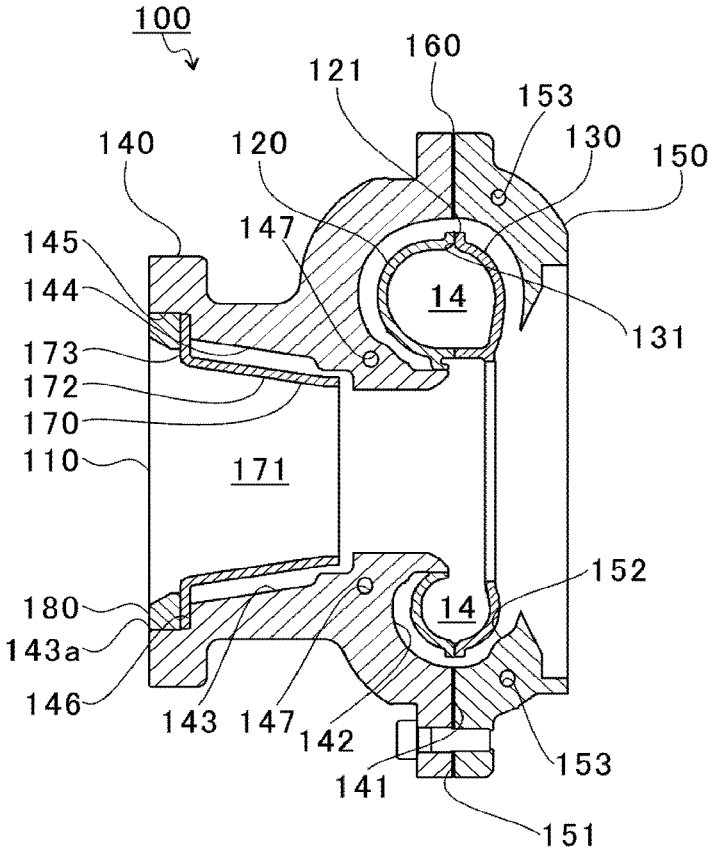
FIG. 3 is a cross-sectional view taken along line III-III in FIG. 2.

FIG. 3 is a cross-sectional view taken along line in FIG. 2. As shown in FIG. 3, the turbine housing 100 includes a first inner member 120, a second inner member 130, a first casting housing 140, and a second casting housing 150. The first inner member 120 and the second inner member 130 are made of sheet metal. The first casting housing 140 and the second casting housing 150 are cast aluminum alloy.

The second inner member 130 is in contact with the first inner member 120 in a rotational axis direction of the turbine impeller 7 (hereinafter simply referred to as an axial direction). A first contacting surface 121 of the first inner member 120 and a second contacting surface 131 of the second inner member 130 contact each other. The first contacting surface 121 and the second contacting surface 131 extend vertically with respect to the axial direction. However, the first contacting surface 121 and the second contacting surface 131 may be inclined with respect to the axial direction.

The turbine scroll flow path 14 is enclosed and defined by the first inner member 120 and the second inner member 130. A cross-sectional shape of the turbine scroll flow path 14 which is cut along a plane including the rotational axis of the turbine impeller 7 is approximately circle. However, the cross-sectional shape of the turbine scroll flow path 14 may be any other shape. The first inner member 120 and the second inner member 130 together, as well as the turbine scroll flow path 14, extend approximately in the rotational direction of the turbine impeller 7.

The first casting housing 140 covers a side of the first inner member 120 that is opposite to the second inner member 130 (opposite to the turbine scroll flow path 14, the left side in FIG. 3). The second casting housing 150 covers a side of the second inner member 130 that is opposite to the first inner member 120 (opposite to the turbine scroll flow path 14, the right side in FIG. 3).

A first end face 141 is formed on the first casting housing 140 on a side closer to the second casting housing 150. A second end face 151 is formed on the second casting housing 150 on a side closer to the first casting housing 140. The first end face 141 and the second end face 151 extend vertically with respect to the axial direction. However, the first end face 141 and the second end face 151 may be inclined with respect to the axial direction. A gasket 160 is disposed between the first end face 141 and the second end face 151. The gasket 160 improves the sealing performance between the first end face 141 and the second end face 151.

A first hollow part 142 is formed on the first end face 141. The first hollow part 142 is recessed from the first end face 141 in the axial direction. The first hollow part 142 extends along the first inner member 120. A second hollow part 152 is formed on the second end face 151. The second hollow part 152 is recessed from the second end face 151 in the axial direction. The second hollow part 152 extends along the second inner member 130. The first inner member 120 and the second inner member 130 are disposed in a space enclosed by the first hollow part 142 and the second hollow part 152. A gap is formed between the first inner member 120 and the second inner member 130 and the first casting housing 140 and the second casting housing 150. An undescribed heat insulator is accommodated in this gap. However, even if no heat insulator is provided, there is an effect of heat insulation by air. The gap between the first inner member 120 and the first casting housing 140 is larger than the thickness of the first inner member 120. However, the gap between the first inner member 120 and the first casting housing 140 may be smaller than or approximately equal to the thickness of the first inner member 120. The gap between the second inner member 130 and the second casting housing 150 is greater than the thickness of the second inner member 130. However, the gap between the second inner member 130 and the second casting housing 150 may be smaller than or approximately equal to the thickness of the second inner member 130.

It is conceivable that the first casting housing 140 and the second casting housing 150 would be made of sheet metal similar to the first inner member 120 and the second inner member 130. In this case, a flexibility of the shape is lower and a size becomes large. In addition, as described above, forming castings along the first inner member 120 and the second inner member 130 would not be easy, since the shapes are complicated and it is difficult to remove sand. If the structure is divided into the first casting housing 140 and the second casting housing 150, the first hollow part 142 and the second hollow part 152 face the first end face 141 and the second end face 151. This makes it easier to remove sand and facilitate casting.

An outlet aperture 143 (aperture) is formed in the first casting housing 140. One end of the outlet aperture 143 on the opposite side of the second casting housing 150 (left side in FIG. 3) is an opening 143*a*. The opening 143*a* opens to the outside of the turbine housing 100. The outlet aperture 143 extends to the radially inner side of the turbine scroll flow path 14.

An inclined portion 144 and a large diameter portion 145 are formed at one half of the outlet aperture 143. The inclined portion 144 is inclined with respect to the axial direction. The inner diameter of the inclined portion 144 decreases as closer to the second casting housing 150. The large diameter portion 145 is located at one end of the outlet aperture 143 with respect to the inclined portion 144. The inner diameter of the large diameter portion 145 is larger than that of the inclined portion 144. The large diameter portion 145 and the inclined portion 144 are connected by a step surface 146. The step surface 146 is, for example, perpendicular to the axial direction. However, the step surface 146 may be inclined with respect to the axial direction. The inclined portion 144 may also extend in the axial direction.

A tube member 170 and a press-fit member 180 are arranged in the outlet aperture 143. The tube member 170 is made of sheet metal. An outlet flow path 171 is defined inside the tube member 170. The outlet flow path 171 is connected to the turbine scroll flow path 14 through the outlet aperture 143. The press-fit member 180 is located closer to the opening 143*a* with respect to the tube member 170. The above-described outlet 110 is formed in the press-fit member 180. The exhaust gas that has passed through the turbine scroll flow path 14 is discharged from the outlet 110 through the outlet flow path 171.

The tube member 170 has a cylindrical portion 172 and a flange portion 173. The cylindrical portion 172 is inclined with respect to the axial direction. The cylindrical portion 172 is inclined in approximately the same direction as the inclined portion 144. A gap is formed between the cylindrical portion 172 and the inclined portion 144 in the radial direction. The gap between the cylindrical portion 172 (tube member 170) and the inclined portion 144 (first casting housing 140) is larger than the thickness of the cylindrical portion 172. However, the gap between the cylindrical portion 172 (tube member 170) and the inclined portion 144 (first casting housing 140) may be less than or substantially equal to the thickness of the cylindrical portion 172. This curbs heat transfer to the inclined portion 144. The flange portion 173 is located closer to one end of the outlet aperture 143 with respect to the cylindrical portion 172. The flange portion 173 is perpendicular to the axial direction. However, the flange portion 173 may be inclined with respect to the axial direction. The flange portion 173 is arranged in the large diameter portion 145.

The press-fit member 180 has an annular shape. The press-fit member 180 is press-fitted into the large diameter portion 145. The flange portion 173 is held by the press-fit member 180 and the step surface 146. Accordingly, the tube member 170 is attached to the outlet aperture 143 (first casting housing 140). Since the tube member 170 is easily deformed, it is difficult to press-fit it into the outlet aperture 143. By using the press-fit member 180, the installation of the tube member 170 becomes easier.

Figure 4:
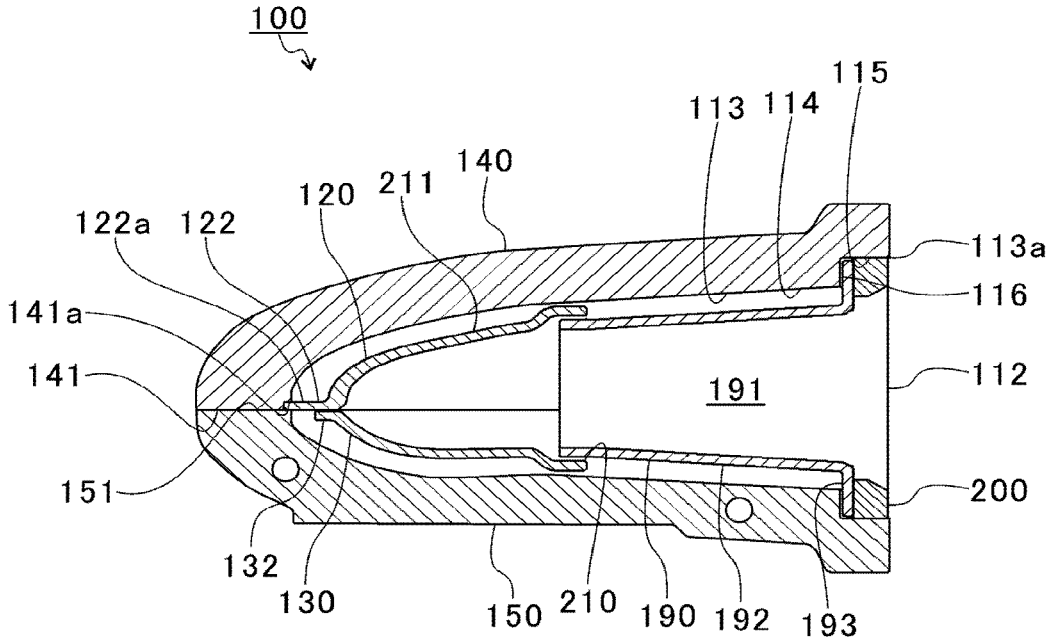
FIG. 4 is a cross-sectional view taken along line IV-IV in FIG. 2.

FIG. 4 is a cross-sectional view taken along IV-IV line in FIG. 2. As shown in FIG. 4, an inlet aperture 113 (aperture) is formed in the turbine housing 100. The inlet aperture 113 is defined by the first casting housing 140 and the second casting housing 150. However, the inlet aperture 113 may be defined by either the first casting housing 140 or the second casting housing 150. An opening 113*a* is formed at one end of the inlet aperture 113. The opening 113*a* opens to the outside of the turbine housing 100. The other end (turbine scroll flow path 14 side) of the inlet aperture 113 is connected to the space enclosed by the first hollow part 142 and the second hollow part 152.

An inclined portion 114 and a large diameter portion 115 are formed on one half of the inlet aperture 113 including the opening 113*a*. In the inlet aperture 113, the inner diameter of the inclined portion 114 is smaller as closer to the turbine scroll flow path 14. The large diameter portion 115 is located closer to the opening 113*a* of the inlet aperture 113 with respect to the inclined portion 114. The inner diameter of the large diameter portion 115 is larger than that of the inclined portion 114. The large diameter portion 115 and the inclined portion 114 are connected by a step surface 116. The step surface 116 is, for example, perpendicular to the axial direction. However, the step surface 116 may be inclined with respect to the axial direction.

A tube member 190 and a press-fit member 200 are disposed in the inlet aperture 113. The tube member 190 is made of sheet metal. An inlet flow path 191 is formed inside the tube member 190. The inlet flow path 191 is connected to the turbine scroll flow path 14. The press-fit member 200 is located closer to the opening 113*a* with respect to the tube member 190. The above-described inlet 112 is formed in the press-fit member 200. The exhaust gas flowing in the inlet 112 flows into the turbine scroll flow path 14 through the inlet flow path 191.

The tube member 190 has a cylindrical portion 192 and a flange portion 193. The cylindrical portion 192 is inclined with respect to the axial direction. The cylindrical portion 192 is inclined in approximately the same direction as the inclined portion 114. A gap is formed between the cylindrical portion 192 and the inclined portion 114 in the radial direction. This curbs heat transfer to the inclined portion 114. The flange portion 193 is located closer to the opening 113*a* of the inlet aperture 113 with respect to the cylindrical portion 192. The flange portion 193 is perpendicular to the axial direction. However, the flange portion 193 may be inclined with respect to the axial direction. The flange portion 193 is arranged in the large diameter portion 115.

The press-fit member 200 has an annular shape. The press-fit member 200 is press-fitted into the large diameter portion 115. The flange 193 is held by the press-fit member 200 and the step surface 116. Accordingly, the tube member 190 is attached to the inlet aperture 113 (first casting housing 140). Since the tube member 190 is easily deformed, it is difficult to press-fit it into the inlet aperture 113. By using the press-fit member 200, the installation of the tube member 190 becomes easier.

The first contacting surface 121 is formed on the first inner member 120 at an end 122 opposite to the tube member 190. The second contacting surface 131 is formed on the second inner member 130 at an end 132 opposite to the tube member 190. The end 122 has a protrusion 122*a* extending in a direction (left in FIG. 4) spaced apart from the tube member 190, with respect to the end portion 132. A groove 141*a* is formed in the first end face 141 of the first casting housing 140. The protrusion 122*a* is inserted into the groove 141*a*. The protrusion 122*a* is held by the first end face 141 and the second end face 151. A plurality of such protrusions 122*a* and grooves 141*a* are formed spaced apart in the rotational direction of the turbine impeller 7. By holding the protrusions 122*a*, the first casting housing 140 and the second casting housing 150 are attached to the first inner member 120 and the second inner member 130. In this embodiment, the protrusion 122*a* is provided on the first inner member 120. However, the protrusion 122*a* may be provided on the second inner member 130. In this case, the groove 141*a* is provided on the second end face 151.

The first inner member 120 and the second inner member 130 define an inner opening 210 and a connecting portion 211. The inner opening 210 opens to the inlet 112. The connecting portion 211 extends from the inner opening 210 to the turbine scroll flow path 14. In other words, the connecting portion 211 is located between the turbine scroll flow path 14 and the tube member 190. The connecting portion 211 is connected to the turbine scroll flow path 14 and the inlet flow path 191.

One end of the tube member 190 is inserted into the inner opening 210. In other words, the connecting portion 211 radially faces (overlaps with) one end of the tube member 190. In this embodiment, the tube member 190 is inserted into the connecting portion 211. However, the connecting portion 211 may be inserted into the tube member 190. Note that it is more difficult for gas to leak when the tube member 190 is inserted into the connecting portion 211.

Even when the tube member 190 and the connecting portion 211 expand and contract in the left-right direction (in the central axis direction of the tube member 190) in FIG. 4 due to thermal deformation, expansion and contraction are allowed between the tube member 190 and the connecting portion 211. As a result, a stress acting on the tube member 190 and the connecting portion 211 is curbed. In this embodiment, the tube member 190 and the connecting portion 211 are not in contact with each other. However, the tube member 190 and the connecting portion 211 may contact with each other in the radial direction, as long as the relative movement of the tube member 190 in the central axis direction is allowed. Furthermore, the tube member 190 and the connecting portion 211 may also contact with each other in the central axis direction, as long as the relative movements of the tube member 190 and the connecting portion 211 in the radial direction are allowed.

As shown in FIG. 3, a first cooling flow path 147 is formed in the first casting housing 140. A second cooling flow path 153 is formed in the second casting housing 150. The first cooling flow path 147 and the second cooling flow path 153 include, for example, a portion extending around the central axis of the outlet aperture 143. However, the paths of the first cooling flow path 147 and the second cooling flow path 153 are not limited thereto and may be any path. A cooling medium, such as cooling water, flows in the first cooling flow path 147 and the second cooling flow path 153.

The following are several examples of the path patterns of the first and second cooling flow paths 147 and 153.

Figure 5:
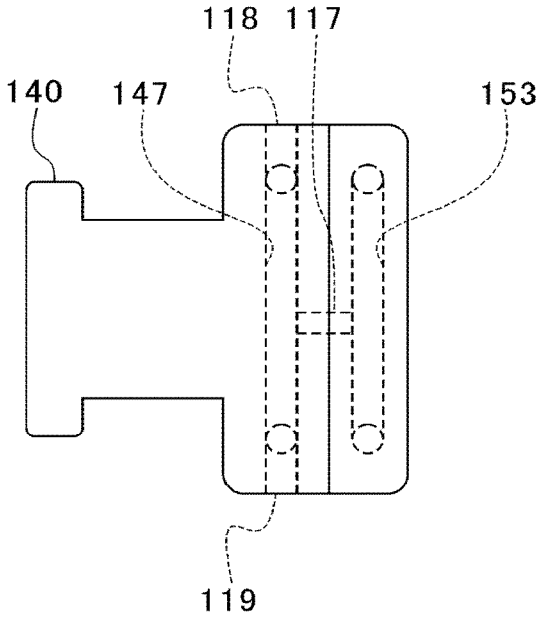
FIG. 5 is a first illustration of first and second cooling flow paths.

FIG. 5 is a first illustration of the first cooling flow path 147 and the second cooling flow path 153. In the path pattern shown in FIG. 5, the first cooling flow path 147 and the second cooling flow path 153 are connected by a connecting flow path 117. One or more connecting flow paths 117 are formed. A cooling inlet 118 (first opening) and a cooling outlet 119 (first opening) that are connected to the first cooling flow path 147 are formed in the first casting housing 140.

The cooling medium flows from the cooling inlet 118 into the first cooling flow path 147. The cooling medium then flows into the second cooling flow path 153 through the connecting flow path 117 and returns to the first cooling flow path 147 through another connecting flow path 117. The cooling medium is discharged from the cooling outlet 119.

Figure 6:
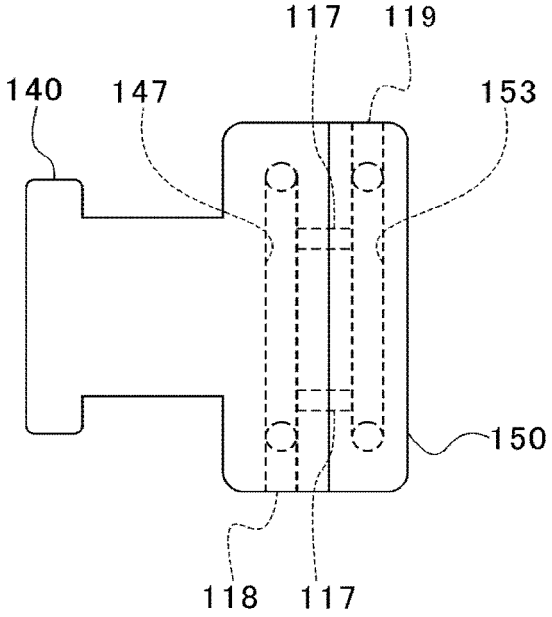
FIG. 6 is a second illustration of the first and second cooling flow paths.

FIG. 6 is a second illustration of the first cooling flow path 147 and the second cooling flow path 153. In the path pattern shown in FIG. 6, the first cooling flow path 147 and the second cooling flow path 153 are connected by a connecting flow path 117. One or more connecting flow paths 117 are formed. A cooling inlet 118 (first opening) is formed in the first casting housing 140. A cooling outlet 119 (second opening) is formed in the second casting housing 150.

The cooling medium flows into the first cooling flow path 147 from the cooling inlet 118. The cooling medium then flows into the second cooling flow path 153 through the connecting flow path 117 and is discharged from the cooling outlet 119. In this embodiment, the cooling inlet 118 is formed in the first casting housing 140 and the cooling outlet 119 is formed in the second casting housing 150. However, the cooling inlet 118 may be formed in the second casting housing 150 and the cooling outlet 119 may be formed in the first casting housing 140.

Figure 7:
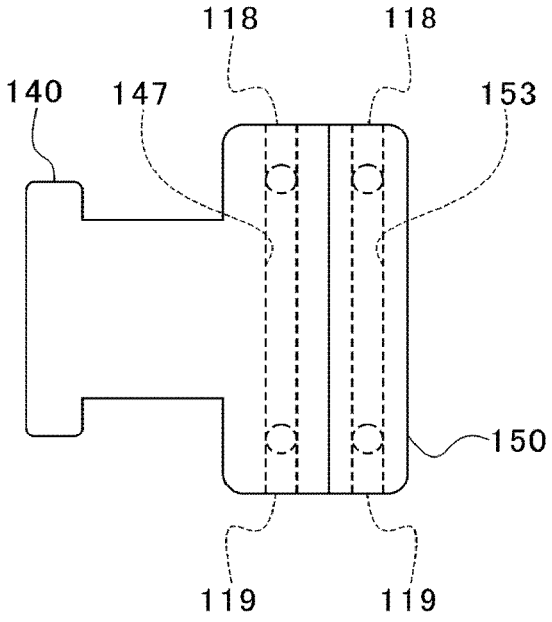
FIG. 7 is a third illustration of the first and second cooling flow paths.

FIG. 7 is a third illustration of the first cooling flow path 147 and the second cooling flow path 153. In the path pattern shown in FIG. 7, there is no connecting flow path 117. The first cooling flow path 147 and the second cooling flow path 153 are not connected (are divided). Each of the cooling inlet 118 and the colling outlet 119 is formed in both of the first and second casting housings 140 and 150.

In the first casting housing 140, the cooling medium flows in the cooling inlet 118 (first opening) and flows out the cooling outlet 119 (first opening). In the second casting housing 150, the cooling medium flows in the cooling inlet 118 (second opening) and flows out the cooling outlet 119 (second opening).

In this way, the first cooling flow path 147 and the second cooling flow path 153 are formed in the turbine housing 100. Since the turbine housing 100 is divided into two parts, i.e., the first casting housing 140 and the second casting housing 150, the first cooling flow path 147 and the second cooling flow path 153 can be easily formed by casting. In addition, the first cooling flow path 147 and the second cooling flow path 153 improve the cooling performance of the first casting housing 140 and the second casting housing 150. This allows the first casting housing 140 and the second casting housing 150 to be made of inexpensive materials with a lower heat resistance.

The embodiments of the present disclosure have been described with reference to the accompanying drawings, but the present disclosure is not limited thereto. It is clear that those skilled in the art can conceive of various changes or modifications within the scope of the claims, and they are also included in the technical scope of the present disclosure.

For example, the above-described configuration dividing a housing into two parts, such as the first casting housing 140 and the second casting housing 150, may also be applied to the compressor housing 4. This makes it easier to cast the compressor housing 4 when forming cooling flow paths therein.

In the above-described embodiments, the first casting housing 140 and the second casting housing 150 are made of aluminum alloy. In this case, the weight and the cost can be reduced, compared to a case where an expensive heat-resistant material is used. However, the first casting housing 140 and the second casting housing 150 may be made of other materials.

In the above-described embodiments, the first inner member 120 and the second inner member 130 are made of sheet metal. By using sheet metal, the cost can be reduced. However, the first inner member 120 and the second inner member 130 may be made of materials other than sheet metal.

In the above-described embodiments, the tube members 170 and 190 are provided. In this case, heat transfer to the first casting housing 140 and the second casting housing 150 is curbed. Accordingly, it is possible to construct the first casting housing 140 and the second casting housing 150 with inexpensive materials having lower heat resistance. However, the tube members 170 and 190 are not essential.

In the above-described embodiments, the press-fit members 180 and 200 are provided. However, the press-fit members 180 and 200 are not essential.

In the above-described embodiments, there may be no gap in the radial and axial directions between the tube member 190 and the connecting portion 211. Furthermore, the configuration of the overlap by the connecting portion 211 may also be applied to the tube member 170 on the outlet flow path 171.

What is claimed is:

1. A turbine housing comprising:

a first inner member;

a second inner member contacting with the first inner member;

a turbine scroll flow path enclosed and defined by the first inner member and the second inner member;

a first cast housing covering the first inner member at a side opposite to the second inner member;

a second cast housing covering the second inner member at a side opposite to the first inner member;

an aperture formed in one or both of the first cast housing and the second cast housing and including an opening that opens to an outside;

a tube member arranged in the aperture and defining an inlet flow path connected to the turbine scroll flow path; and an inner opening defined by the first inner member and the second inner member and overlapping with one end of the tube member, wherein the first inner member includes a first mating surface on a radially inner side and a second mating surface on a radially outer side, and the first mating surface and the second mating surface mate with the second inner member at least partially around a circumference of the scroll flow path.

2. The turbine housing according to claim 1, comprising:

a first cooling flow path formed in the first cast housing, a cooling medium passing through the first cooling flow path; and a second cooling flow path formed in the second cast housing, a cooling medium passing through the second cooling flow path.

3. The turbine housing according to claim 2, wherein the first cooling flow path and the second cooling flow path are connected.

4. The turbine housing according to claim 3, comprising:

a first opening formed in the first cast housing and connected to the first cooling flow path; and a second opening formed in the second cast housing and connected to the second cooling flow path.

5. The turbine housing according to claim 2, wherein the first and second cooling flow paths are not connected.

6. The turbine housing according to claim 1, wherein one end of the tube member is inserted into the inner opening.

7. The turbine housing according to claim 1, wherein the inner opening and the tube member do not contact with each other.

8. A turbocharger comprising the turbine housing according to claim 1.

* * * * *